US007699662B1

(12) United States Patent
Lee et al.

(10) Patent No.: US 7,699,662 B1
(45) Date of Patent: Apr. 20, 2010

(54) ELECTRICAL CONNECTOR

(75) Inventors: Dick Lee, Hsin-Tien (TW); Jing Jiang, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/361,963

(22) Filed: Jan. 29, 2009

(30) Foreign Application Priority Data

Nov. 10, 2008 (TW) ..... 97220098 U

(51) Int. Cl.
*H01R 24/00* (2006.01)

(52) U.S. Cl. ..... 439/660; 439/885

(58) Field of Classification Search ..... 439/660, 439/885

See application file for complete search history.

(56) References Cited

U.S. PATENT DOCUMENTS

| | | | | |
|---|---|---|---|---|
| 4,684,203 | A * | 8/1987 | Bihler | 439/751 |
| 5,224,867 | A * | 7/1993 | Ohtsuki et al. | 439/108 |
| 6,406,338 | B1 * | 6/2002 | Endo et al. | 439/885 |
| 6,685,508 | B2 * | 2/2004 | Zhu et al. | 439/607.23 |
| 6,712,650 | B1 * | 3/2004 | Cheng | 439/891 |
| 6,764,357 | B2 * | 7/2004 | Wu et al. | 439/885 |
| 7,422,494 | B2 * | 9/2008 | Fry et al. | 439/891 |
| 7,438,590 | B1 | 10/2008 | Liang at al. | |

* cited by examiner

*Primary Examiner*—Truc T Nguyen
(74) *Attorney, Agent, or Firm*—Rabin & Berdo, P.C.

(57) ABSTRACT

An electrical connector has an insulative housing and a plurality of terminals. The insulative housing has a base and a tongue. The terminals are mounted in the insulative housing by an insert-molding process. Each terminal has first and second positioning tabs formed transversely on the terminal and embedded into the tongue to prevent the terminal from inadvertently moving relative to the insulative housing.

9 Claims, 12 Drawing Sheets

ELECTRICAL CONNECTOR

BACKGROUND OF THE INVENTION

1. Field of the Invention

The present invention relates to a connector, and more particularly to an electrical connector that has an insulative housing and terminals with variation of width so that the terminals are held securely in the insulative housing.

2. Description of Related Art

Electrical connectors are used widely in or on electronic devices such as cellular phones and laptops. For instance, communication between laptops and peripherals are through electrical connectors.

One of common electrical connectors, such as disclosed in U.S. Pat. No. 7,438,590, is the low-voltage-differential-signaling (LVDS) connector that is mounted in electronic devices and is capable of transmitting high and low voltage signals. Conventional LVDS connectors have an insulative housing, a plurality of terminals and two metal shells. The terminals are mounted securely in the insulative housing by an insert-molding process. The metal shells cover the insulative housing to shields the insulative housing and improve the structural strength of the LVDS connector.

However, the terminals of the conventional LVDS connector are not held stably by the insulative housing and easily loosen, move or fall out of the insulative housing after times of the LVDS connector engaged with and disengaged from a mating connector.

To overcome the shortcomings, the present invention provides an electrical connector to mitigate or obviate the aforementioned problems.

SUMMARY OF THE INVENTION

The main objective of the invention is to provide an electrical connector that has an insulative housing and terminals with variation of width so that the terminals are held securely in the insulative housing.

An electrical connector in accordance with the present invention has an insulative housing and a plurality of terminals. The insulative housing has a base and a tongue. The terminals are mounted in the insulative housing by an insert-molding process. Each terminal has first and second positioning tabs formed transversely on the terminal and embedded into the tongue to prevent the terminal from inadvertently moving relative to the insulative housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
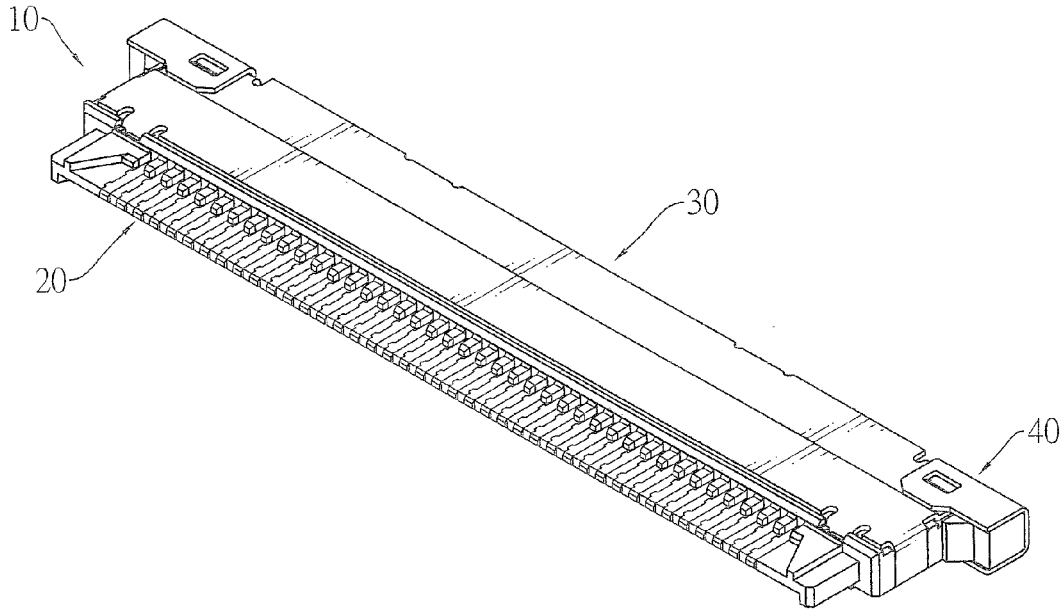
FIG. 1 is a perspective view of the electrical connector in accordance with the present invention.
Figure 2:
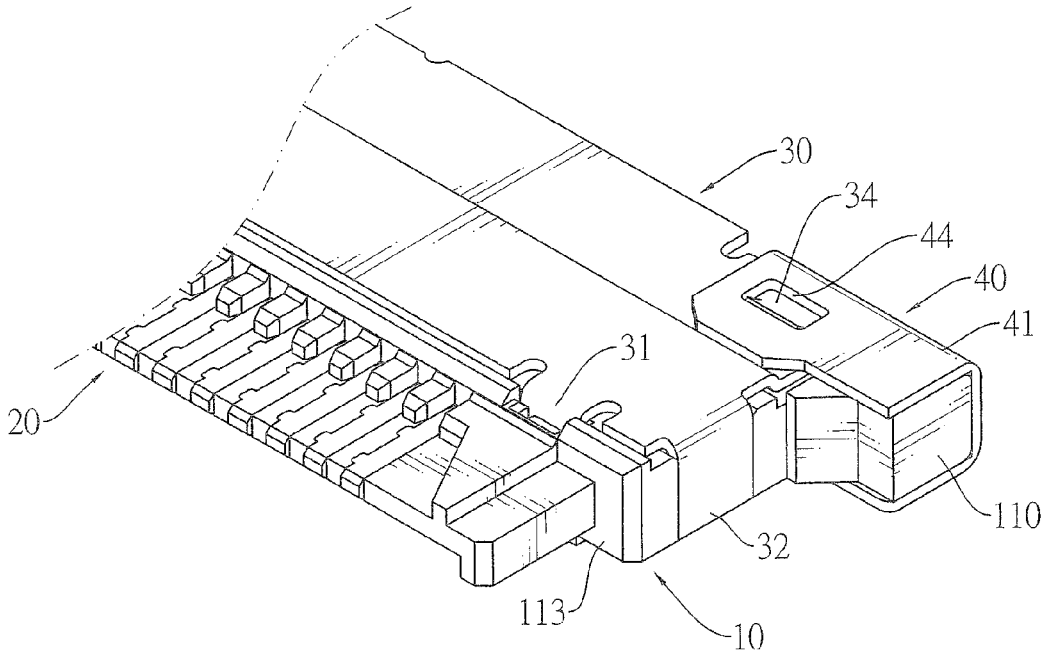
FIG. 2 is an enlarged perspective view of the electrical connector in FIG. 1.
Figure 3:
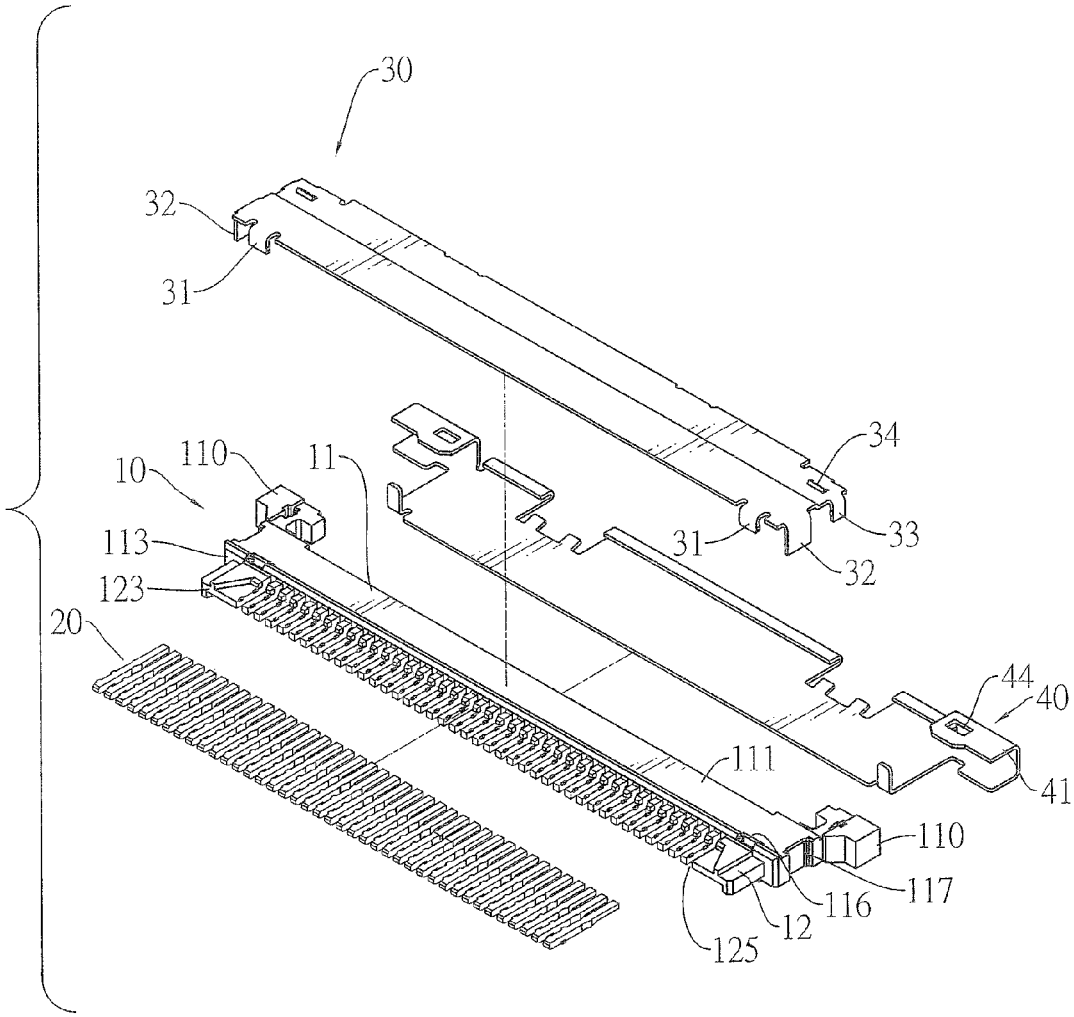
FIG. 3 is an exploded perspective view of the electrical connector in FIG. 1.

With reference to FIGS. 1 to 3, an electrical connector in accordance with the present invention may be a low-voltage-differential-signaling (LVDS) connector and comprises an insulative housing (10), a plurality of terminals (20), a top metal cover (30) and a bottom metal cover (40).

The insulative housing (10) has a base (11) and a tongue (12).

Figure 4:
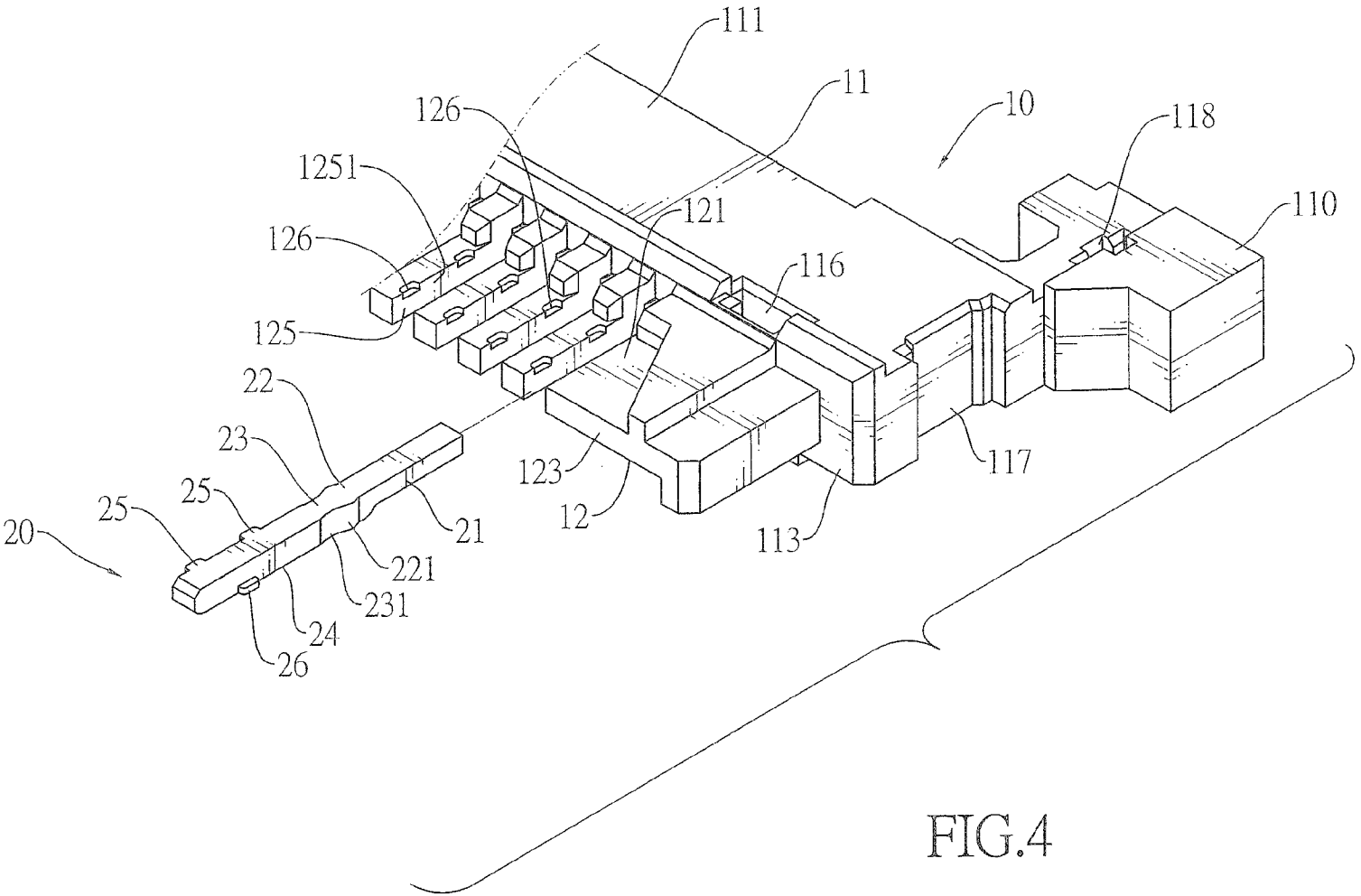
FIG. 4 is an enlarged and exploded top perspective view of the electrical connector in FIG. 3.
Figure 5:
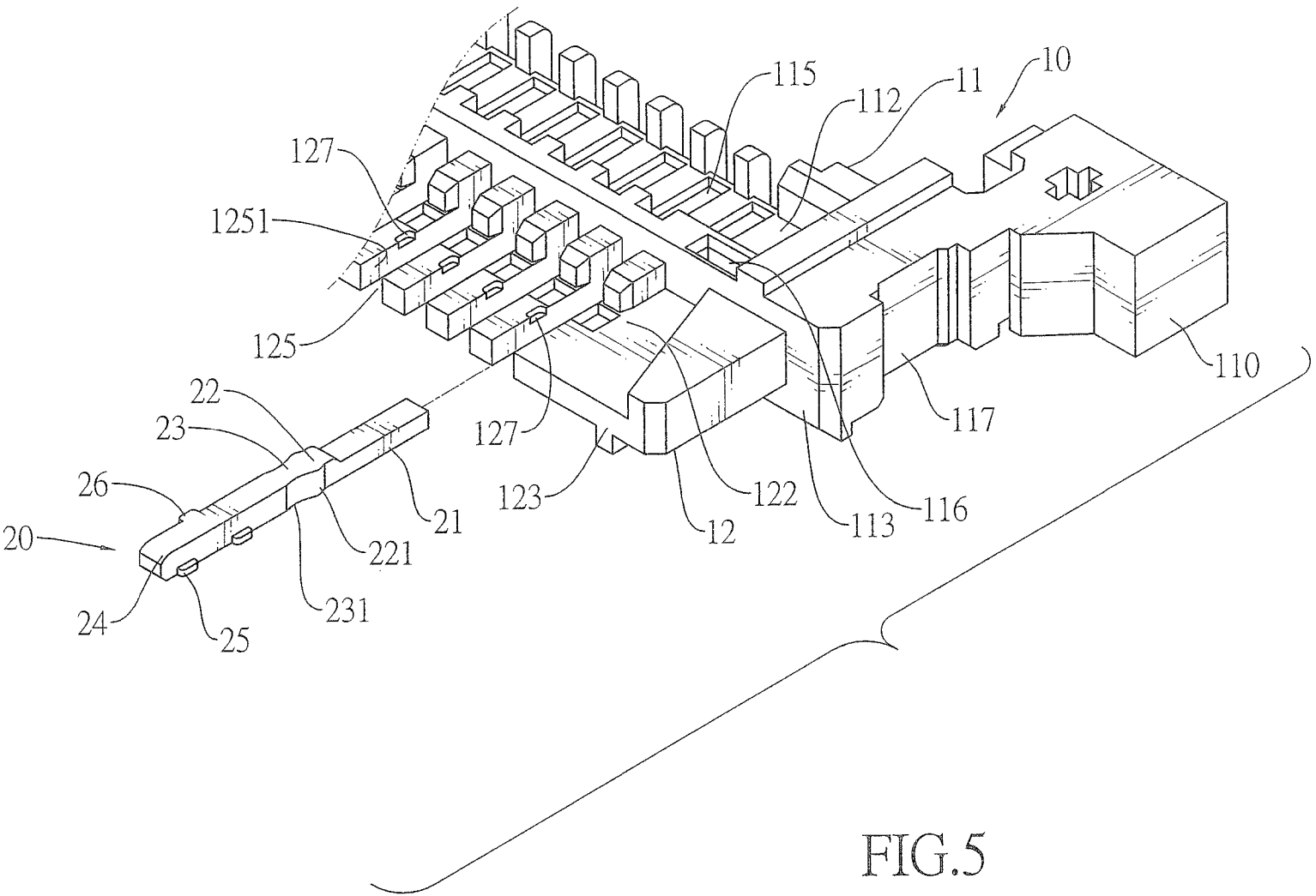
FIG. 5 is an enlarged and exploded bottom perspective view of the electrical connector in FIG. 3
Figure 6:
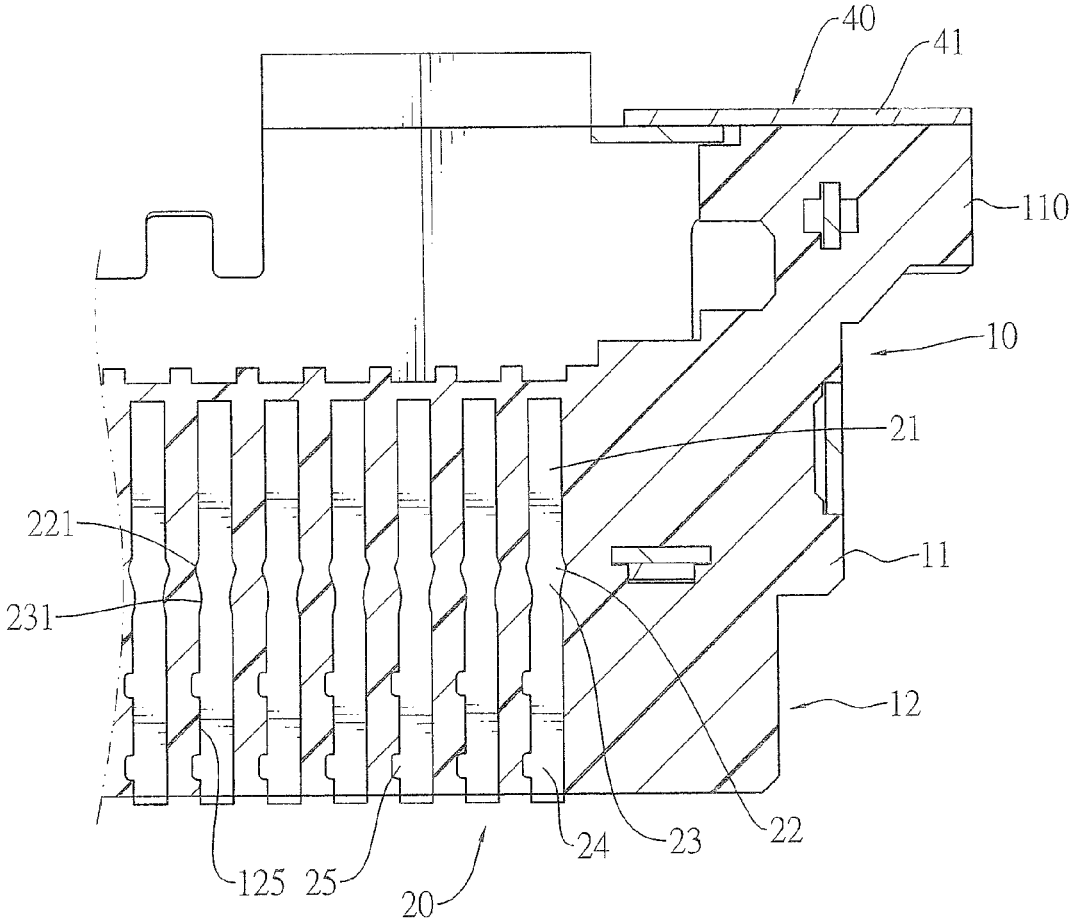
FIG. 6 is an enlarged top view in partial section of the electrical connector in FIG. 1.
Figure 7:
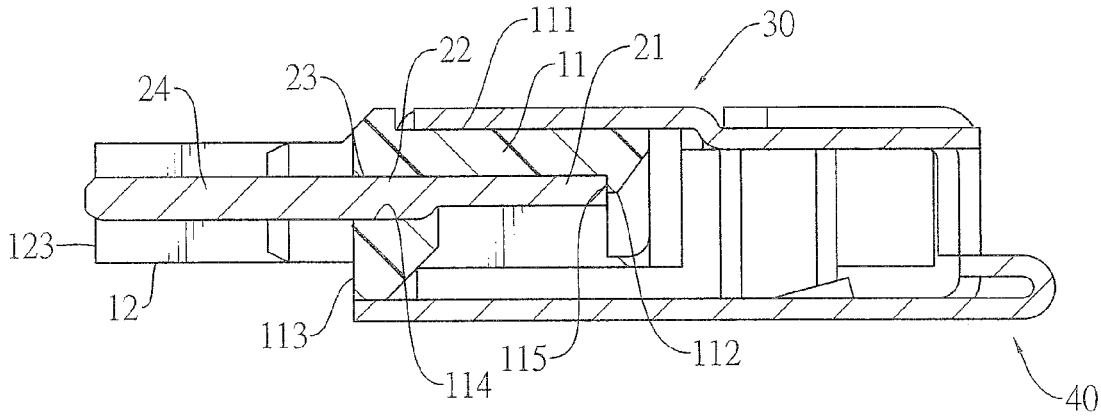
FIG. 7 is a cross sectional side view of the electrical connector in FIG. 1.
Figure 8:
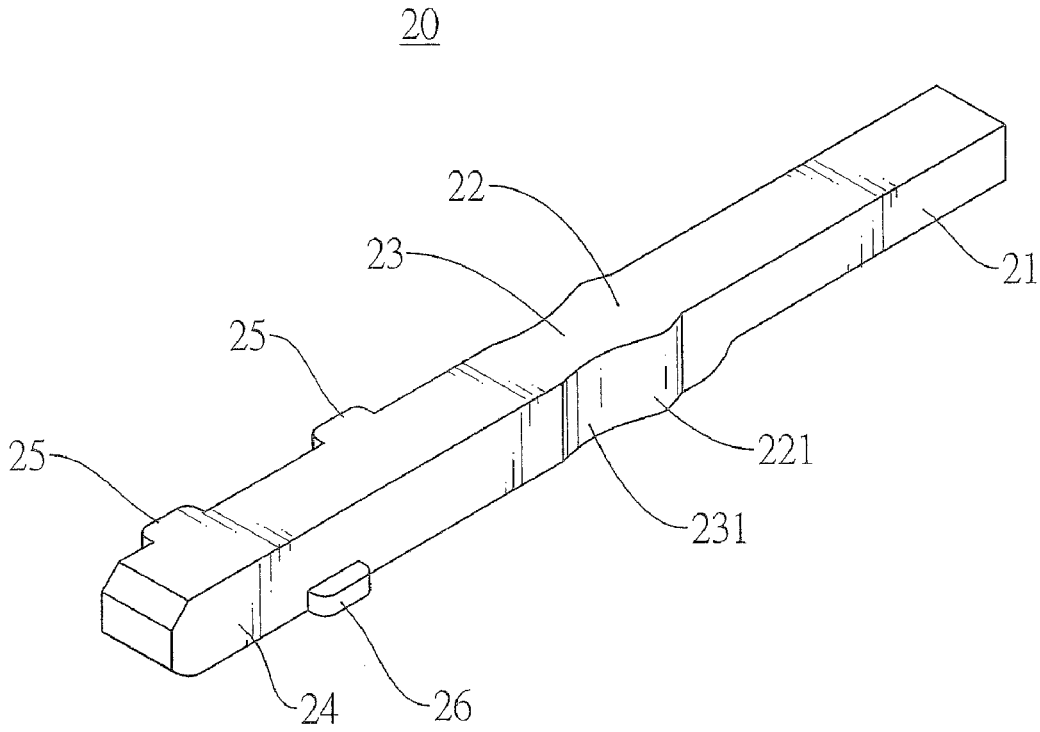
FIG. 8 is a perspective view of the terminal of the electrical connector in FIG. 1.
Figure 9:
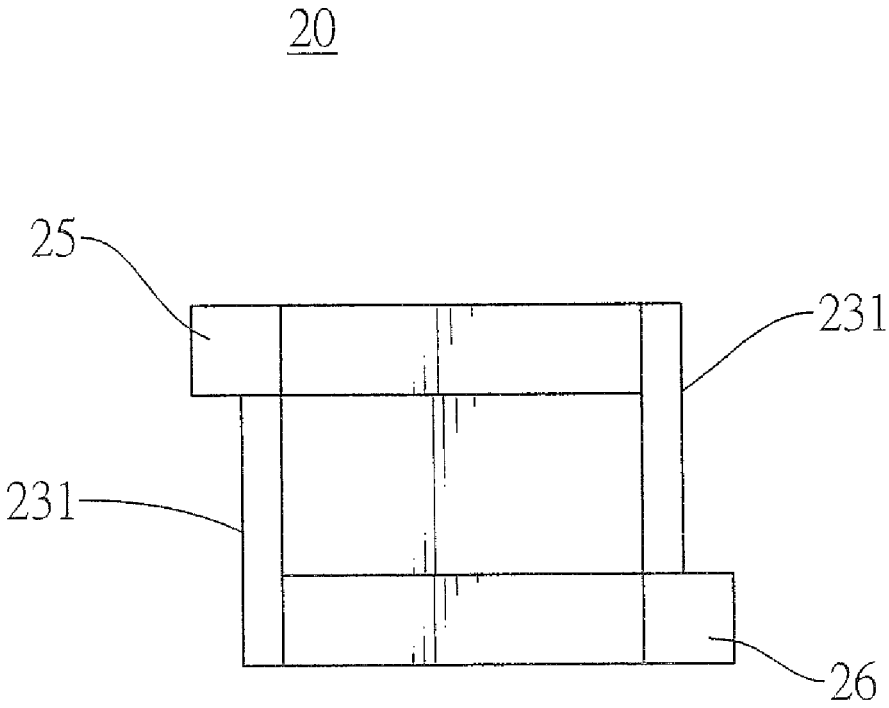
FIG. 9 is a front view of the terminal of the electrical connector in FIG. 8.
Figure 10:
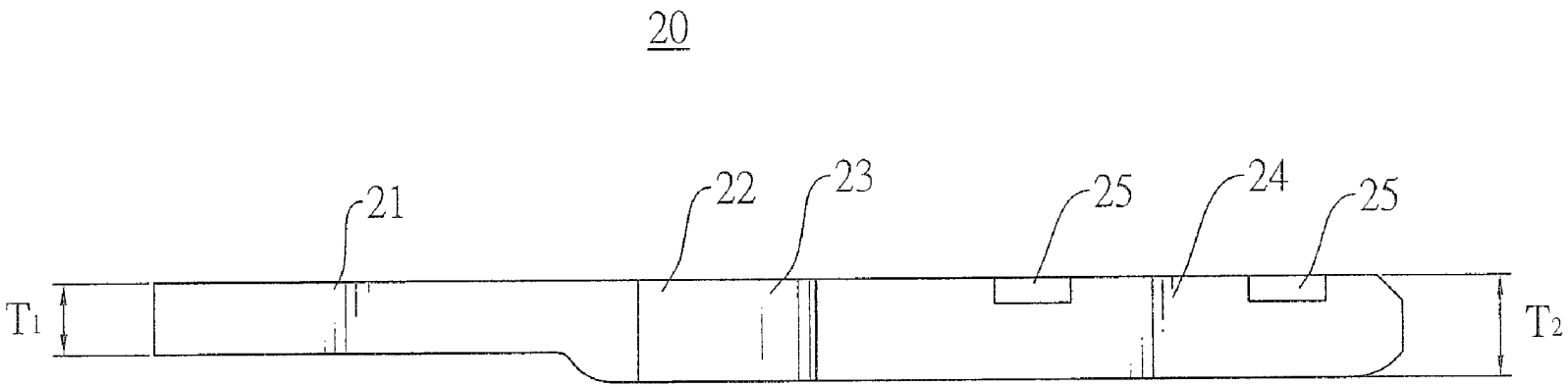
FIG. 10 is a side view of the terminal of the electrical connector in FIG. 8.
Figure 11:
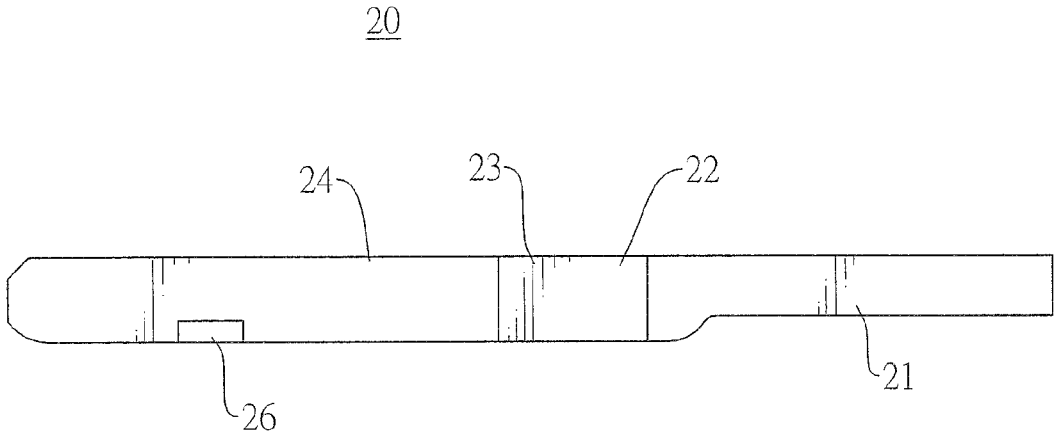
FIG. 11 is another side view of the terminal of the electrical connector in FIG. 8.

With further reference to FIGS. 4, 5 and 7, the base (11) has a top (111), a bottom (112), a front (113), a rear, two opposite sides, a plurality of terminal holes (114) and a plurality of terminal slots (115) and may further have two mounting portions (110), two front fastening holes (116), two outside fastening slots (117) and two rear fastening holes (118). The terminal holes (114) are defined through the base (11) from the front (113) to the rear and each terminal hole (114) has an inner surface. The terminal slots (115) are defined in the bottom (112) and communicate respectively with the terminal holes (114). The mounting portions (110) are formed on and protrude respectively from the sides of the base (11). The front fastening holes (116) are defined through the base (11) from the top (111) to the bottom (112) and are adjacent to the front (113). The outside fastening slots (117) are defined respectively in the sides. The rear fastening holes (118) are defined respectively through the mounting portions (110).

The tongue (12) is formed on and protrudes forwards from the front (113) of the base (11) and has a top (121), a bottom (122), a front end (123), two opposite sides and a plurality of terminals channels (125). The terminal channels (125) are defined longitudinally through the tongue (12) from the front end (123), communicate respectively with the terminal holes (114) of the base (11) and each terminal channel (125) may further have two opposite inside surfaces (1251), at least one first embedding notch (126) and at least one second embedding notch (127). The at least one first embedding notch (126) is defined in one of the inside surfaces (1251) adjacent to the top (121) of the tongue (12) and may be two first embedding notches (126). The at least one second embedding notch (127) is defined in the other inside surface (1251) adjacent to the bottom (122) of the tongue (12) and may be a singular second embedding notch (127).

With further reference to FIGS. 6 and 8-12, the terminals (20) are held securely in the insulative housing (10) by an insert-molding process, correspond respectively to and are mounted respectively through the terminal holes (114) of the base (11), correspond respectively to and are mounted respectively in the terminal slots (115) of the tongue (12) and correspond respectively to and are mounted respectively in the terminal channels (125) of the tongue (12). Each terminal (20) has a connecting end (21), a mounting end and a contacting end (24).

The connecting end (21) is mounted in the bottom (112) of the base (11) and may be connected to a printed circuit board (PCB) by soldering or wires so that the electrical connector is mounted on the PCB. The connecting end (21) has a width (W1) and a thickness (T1).

The mounting end is formed on and protrudes from the connecting end (21) and has a thickness (T2), a wide section (22) and a narrow section (23). The wide section (22) has a width (W2), two opposite sides and two protrusions (221). The width (W2) of the wide section (22) is larger than the width (W1) of the connecting end (21). The protrusions (221) may be tapered, protrude transversely and respectively outwards from the sides of the wide section (22) and are embedded into and engaged with the inner surface of a corresponding terminal hole (114) of the insulative housing (10) by the insert-molding process. The narrow section (23) is adjacent to the wide section (22) and has a width (W3), two opposite sides and two recesses (231). The width (W3) of the narrow section (23) is smaller than the width (W1) of the connecting end (21). The recesses (231) are defined respectively in the sides of the narrow section (23) and are embedded into and engaged with the inner surface of the corresponding terminal hole (114).

The contacting end (24) is formed on and protrudes from the mounting end, may protrude from the narrow section (23), is mounted in a corresponding terminal channel (125) of the tongue (12) and may electrically contact a terminal of a mating connector corresponding to the electrical connector. The contacting end (24) has a thickness (T2), a top surface, a bottom surface, two opposite side surfaces, at least one first positioning tab (25) and at least one second positioning tab (26). The thicknesses (T2) of the contacting end (24) and the mounting end are larger than the thickness (T1) of the connecting end (21). Thus, the corresponding terminal hole (114) covers a boundary between the mounting end and the connecting end (21) with thickness variation to prevent the terminal (20) from moving back and forth, as shown in FIG. 7.

The at least one first positioning tab (25) is formed on and protrudes transversely from one side of the contacting end (24), is embedded into the tongue (21), is mounted respectively in the at least one first embedding notch (126) of the corresponding terminal channel (125) and may be two first positioning tabs (25) mounted respectively to the two first embedding notch (126).

Figure 12:
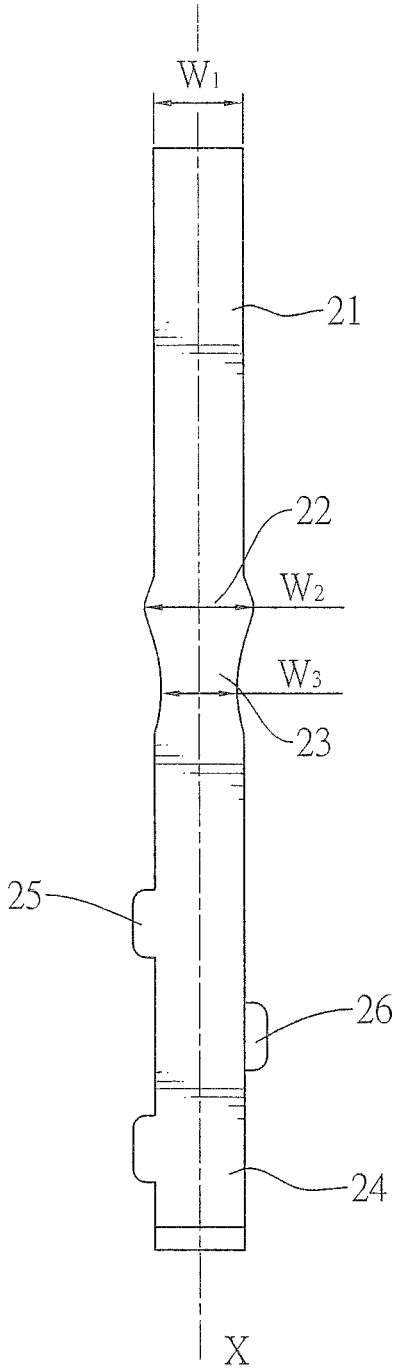
FIG. 12 is a top view of the terminal of the electrical connector in FIG. 9.

The at least one second positioning tab (26) is formed on and protrudes transversely from the other side of the contacting end (24), is embedded into the tongue (21), is mounted respectively in the at least one second embedding notch (127), may be a singular second positioning tab (26) mounted in the second embedding notch (127). Furthermore, the first and second positioning tabs (25, 26) are arranged in a staggered distribution in a longitudinal axis (X) of the terminal (20), as shown in FIG. 12.

The top metal cover (30) covers the top (111) of the base (11) and has a front edge, two opposite sides, two front mounting tabs (31), two outside mounting tabs (32), two rear mounting tabs (33) and two hooking members (34).

The front mounting tabs (31) are mounted respectively in the front fastening holes (116) of the base (11).

The outside mounting tabs (32) are mounted respectively in the outside fastening slots (117) of the base (11).

The rear mounting tabs (33) are mounted respectively in the rear fastening holes (118).

The hooking members (34) are formed on the top metal cover (30).

The bottom metal cover (40) covers the bottom (112) of the base (11) and has two opposite sides and two mounting hooks (41). The mounting hooks (41) are U-shaped, are formed respectively on the sides, are mounted respectively on the mounting portions (110) of the base (11) and each mounting hook (41) has a hooking hole (44). The hooking hole (44) is defined through the mounting hook (41) and are hooked by one of the hooking member (34) of the top metal cover (30).

The terminals (20) of the electrical connector are mounted in the insulative housing (10) by the insert-molding process and the wide section (22) and narrow section (23) of each terminal (20) are embedded in the base (11) to prevent the terminal (20) from moving back and forth relative to the insulative housing (10). Further the first and second positioning tabs (25, 26) of each terminal (20) are embedded in the tongue (12) to prevent the terminal (20) from moving up and down relative to the insulative housing (10). Therefore, repeatedly engaging/disengaging the electrical connector with/from the mating connector would not cause inadvertent disassembly of the terminals (20) from the insulative housing (10). The electrical connector is firm and durable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a base having a top, a bottom, a front, a rear and two opposite sides; and a tongue formed on and protruding from the front of the base and having a top, a bottom, a front end and two opposite sides; and a plurality of terminals mounted through the base and mounted in the tongue of the insulative housing and each terminal having a connecting end mounted in the bottom of the base and having a width and a thickness;

a mounting end formed on and protruding from the connecting end and having a thickness;

a wide section having two opposite sides and a width larger than the width of the connecting end; and a narrow section having two opposite sides and a width smaller than the width of the connecting end; and a contacting end formed on and protruding from the mounting end, mounted in the tongue and having a thickness, a top surface, a bottom surface and two opposite side surfaces and further having at least one first positioning tab formed on and protruding transversely from one side of the contacting end and embedded into the tongue; and at least one second positioning tab formed on and protruding transversely from the other side of the contacting end and embedded into the tongue.

2. The electrical connector as claimed in claim 1, wherein the base has a plurality of terminal holes defined through the base from the front to the rear and each terminal hole having an inner surface; and a plurality of terminal slots defined in the bottom and communicating respectively with the terminal holes;

wherein the terminals correspond respectively to and are mounted respectively through the terminal holes and correspond respectively to and are mounted respectively in the terminal slots.

3. The electrical connector as claimed in claim 2, wherein the tongue having a plurality of channels defined longitudinally through the tongue from the front end, communicating respectively with the terminal holes and each terminal channel having two opposite inside surfaces, wherein the terminals correspond respectively to and are mounted respectively in the terminal channels.

4. The electrical connector as claimed in claim 3, wherein the wide section of each terminal further has two protrusions protruding transversely and respectively outwards from the sides of the wide section and embedded into the inner surface of a corresponding terminal hole.

5. The electrical connector as claimed in claim 4, wherein the narrow section of each terminal further has two recesses are defined respectively in the sides of the narrow sections and engaged with the inner surface of the corresponding terminal hole.

6. The electrical connector as claimed in claim 5, wherein each terminal channel further has at least one first embedding notch defined in one of the inside surfaces adjacent to the top of the tongue; and at least one second embedding notch defined in the other inside surface adjacent to the bottom of the tongue; and the at least one first positioning tab of each terminal is mounted respectively in the at least one first embedding notch of the corresponding terminal channel; and the at least one second positioning tab of each terminal is mounted respectively in the at least one second embedding notch of the corresponding terminal channel.

7. The electrical connector as claimed in claim 6, wherein the first and second positioning tabs of each terminal are arranged in a staggered distribution in a longitudinal axis of the terminal.

8. The electrical connector as claimed in claim 7, wherein the thicknesses of the contacting end and the mounting end are larger than the thickness of the connecting end of each terminal, wherein the corresponding terminal hole covers a boundary between the mounting end and the connecting end.

9. The electrical connector as claimed in claim 8, wherein the base further has two mounting portions formed on and protruding respectively from the sides of the base;

two front fastening holes defined through the base from the top to the bottom adjacent to the front;

two outside fastening holes defined respectively in the sides of the base; and two rear fastening holes defined respectively through the mounting portions;

a top metal cover covers the top of the base and has a front edge and two opposite sides and further has two front mounting tabs mounted respectively in the front fastening holes;

two outside mounting tabs mounted respectively in the outside fastening slots;

two rear mounting tabs mounted respectively in the rear fastening holes; and two hooking members formed on the top metal cover; and a bottom metal cover covers the bottom of the base and has two opposite sides and two mounting hooks being U-shaped, formed respectively on the sides, are mounted respectively on the mounting portions of the base and each mounting hook having a hooking hole defined through the mounting hook and hooked by one of the hooking member.

* * * * *